United States Patent [19]

Springston et al.

[11] Patent Number: 4,629,358

[45] Date of Patent: Dec. 16, 1986

[54] PREFABRICATED PANELS FOR RAPID RUNWAY REPAIR AND EXPEDIENT AIRFIELD SURFACING

[75] Inventors: Preston S. Springston, Oxnard; Richard L. Claxton, Camarillo, both of Calif.

[73] Assignee: The United States of America as represented by the Secretary of the Navy, Washington, D.C.

[21] Appl. No.: 631,954

[22] Filed: Jul. 17, 1984

[51] Int. Cl.[4] ..... E01C 5/20; E01C 11/02

[52] U.S. Cl. ..... 404/35; 404/41; 404/44; 428/193; 428/251

[58] Field of Search ..... 404/35, 36, 40, 41, 404/44; 428/137, 193, 251; 403/388, 393, 408.1; 52/584, 582; 405/153

[56] References Cited

U.S. PATENT DOCUMENTS

| | | | |
|---|---|---|---|
| 1,472,521 | 10/1923 | Harrison | 404/41 X |
| 3,076,390 | 2/1963 | Custer | 404/35 |
| 3,346,219 | 10/1967 | Salyer et al. | 404/35 X |
| 3,379,104 | 4/1968 | Scholl | 404/35 |
| 3,385,183 | 5/1968 | Kortz | 52/582 X |
| 3,557,670 | 1/1971 | Sutton | 404/35 |
| 3,616,111 | 10/1971 | Raech, Jr. | 404/41 X |
| 3,694,983 | 10/1972 | Couquet | 404/44 X |
| 4,344,995 | 8/1982 | Hammer | 428/137 X |
| 4,404,244 | 9/1983 | Springston | 428/137 X |
| 4,507,011 | 3/1985 | Brown | 428/251 X |

FOREIGN PATENT DOCUMENTS

| | | | |
|---|---|---|---|
| 1534246 | 12/1969 | Fed. Rep. of Germany | 404/41 |

*Primary Examiner*—James A. Leppink
*Assistant Examiner*—Matthew Smith
*Attorney, Agent, or Firm*—Robert F. Beers; Joseph M. St. Amand

[57] ABSTRACT

Low profile portable panels consisting of fiberglass-reinforced plastic composite mats which include hollow inorganic silica spheres in the plastic resin to reduce weight have recessed molded lips and bushings along all edges for connecting panels together with bolts to form expedient airfield surfacing and repair having high flexural strength and high structural capacity.

13 Claims, 6 Drawing Figures

PREFABRICATED PANELS FOR RAPID RUNWAY REPAIR AND EXPEDIENT AIRFIELD SURFACING

BACKGROUND OF THE INVENTION

This invention relates to portable mats which are interconnected together to form and/or repair airfield runways.

Currently there are a variety of portable airfield landing mats in the prior art literature. However, most such mats are for lightweight aircraft, helicopters and VTO aircraft, and are unsuitable for heavy aircraft. One matting presently in use for surfacing of expeditionary airfields and for rapid runway repair consists of extruded aluminum planks. The aluminum matting planks, however, are difficult to produce and are expensive, and also present a bump profile which causes overstressing of critical components of aircraft which must traverse bomb craters in runways surfaced over with such matting. Other landing mats involve complex laminar and/or mechanical structures which are also difficult and expensive to produce.

SUMMARY OF THE INVENTION

The present invention is a portable airfield landing mat for commercial and military use in the expedient surfacing of forward area airfields. The invention comprises a panel which can be linked with others to form airfield runways and also to form a protective and trafficable cover over backfilled bomb craters in conventional airfield pavements. The invention has further utility as a relocatable surfacing for runways and parking aprons of V/STOL forward operating facilities and taxiways and parking aprons of expeditionary air bases and expeditionary airfields. The portable panels are characterized by low shipping weight, low shipping cube, and moderate cost. A preferred panel size facilitates effic:ent shipment in standarized 8×8×20-foot shipping containers. The panels can be rapidly assembled either for airfield construction or rapid runway repair.

The portable panels consist of a fiberglass-reinforced plastic composite mat having recessed molded lips and bushings along all edges to accommodate the joining of individual panels. Hollow inorganic silica spheres may be included in plastic resin to reduce weight. Panels are connected together with bolts to form airfield surfacing and pavement repair. These panels present advantages in economy of manufacture, shipping, relocatability, and utility. The panels of this invention also provide higher flexural strength, lower profile, and higher structural capacity than available from prior art landing mats.

DESCRIPTION OF THE PREFERRED EMBODIMENT

Figure 1:
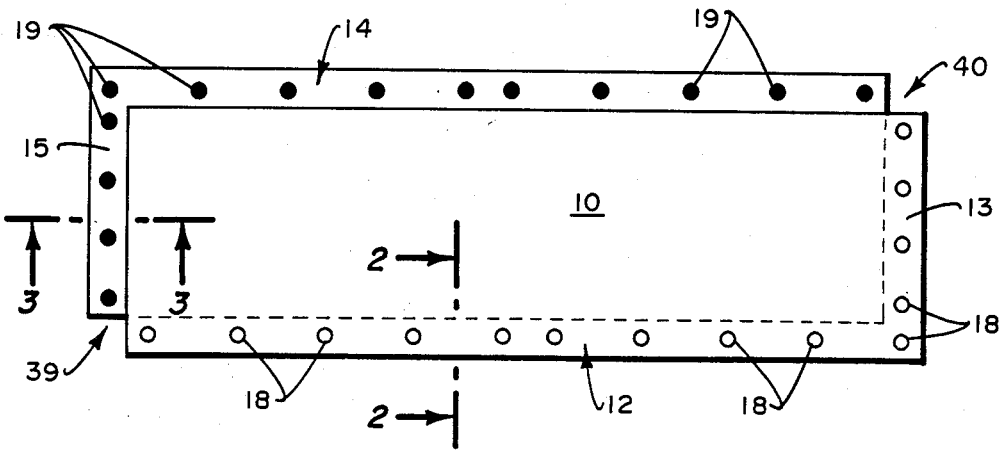
FIG. 1 is a plan view of a prefabricated panel of the present invention.
Figure 2:
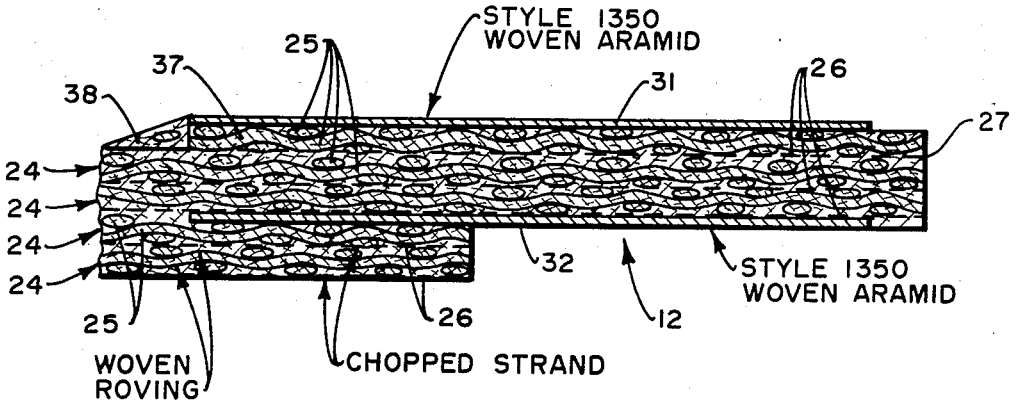
FIG. 2 is a cross-sectional view of an edge section taken along line 2—2 of FIG. 1.
Figure 3:
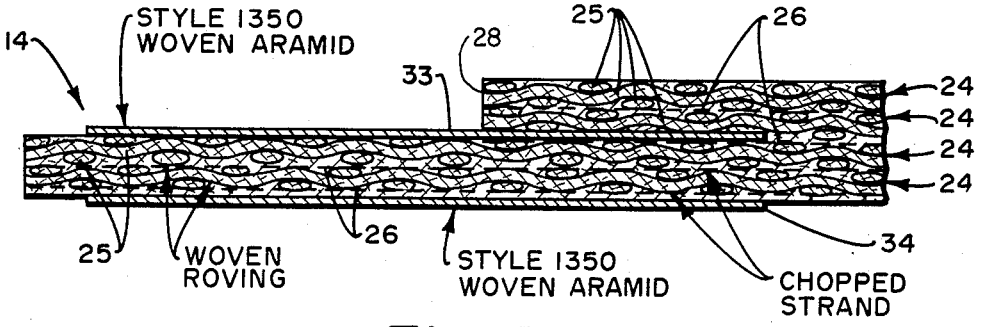
FIG. 3 is a cross-sectional view of an edge section taken along line 3—3 of FIG. 1.
Figure 4:
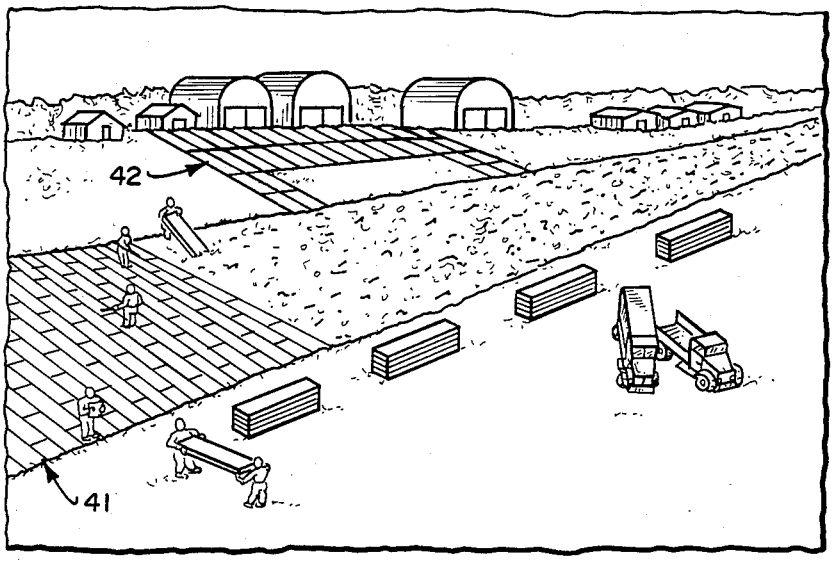
FIG. 4 is an illustration showing assembling of an airfield runway and an airfield apron using the panels of FIG. 1.

The portable airfield landing matting of the present invention is a plastic composite panel 10 having reinforced recessed lips 12, 13, 14 and 15 molded along the edges, as shown in FIG. 1, to accommodate the joining of individual panels. Two adjacent panel edges 12 and 13 comprise recessed lips at the bottom, as shown in FIGS. 1 and 2, whereas the other two adjacent panel edges 14 and 15 comprise matching recessed lips at the top, as shown in FIGS. 1 and 3. Several panels are joined together by overlapping the upper edges (i.e., lips) 12 and 13 of one panel over the lower edges 14 and 15 of previously laid adjacent panels, as shown in FIG. 4, for example, to form an airfield runway or landing mat. A typical panel, as shown in FIG. 1 is, for example, ½ inch thick and measures 6 ft., 8 in. by 18 ft. in plan dimension for storage and shipment in standarized 8 by 8 by 20 ft. shipping containers. The recessed lips along edges 12, 13, 14 and 15 are 8 inches wide and 0.25 to 0.375 inch thick, as shown in FIGS. 2 and 3. All dimensions are given by way of example.

Figure 5A:
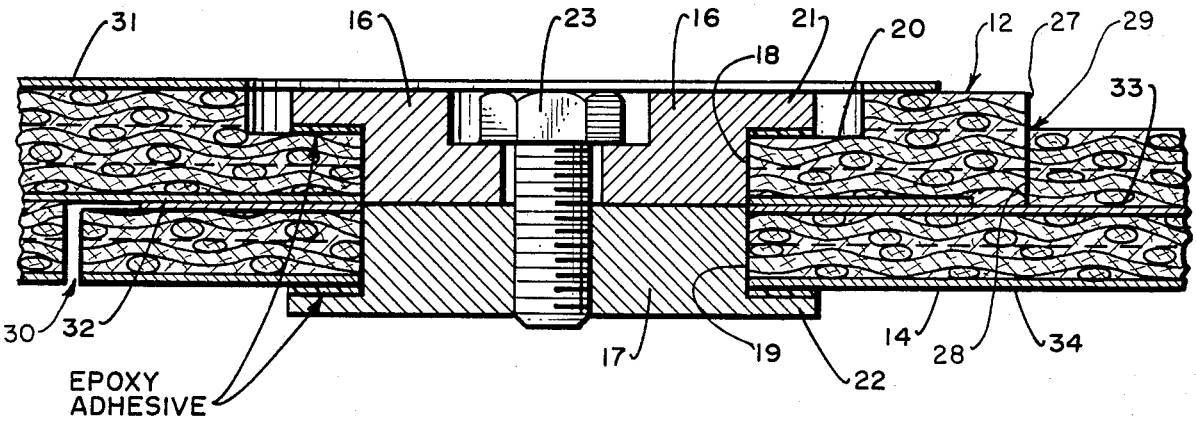
FIG. 5*a* is a cross-sectional view of an assembled joint of overlapping panel edges shown in FIGS. 2 and 3, taken along line 5*a*—5*a* of FIG. 5*b*.
Figure 5B:
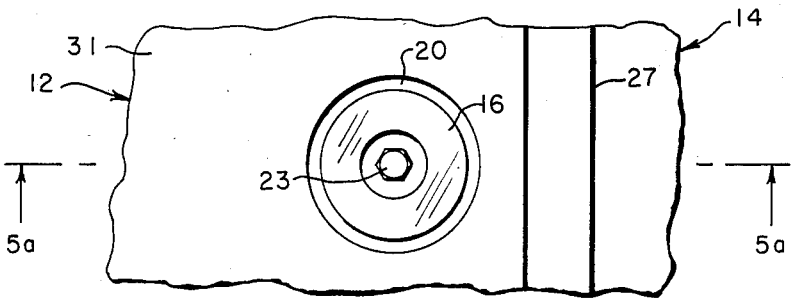
FIG. 5*b* is a top view of the typical joint connection shown in FIG. 5*a*.

The panels 10 have upper bushings 16 positioned along the top joint edges 12 and 13, and lower threaded bushings 17 positioned along the bottom joint edges 14 and 15, as shown in FIGS. 1 and 5. Bushings 16 and 17 fit into holes 18 and 19, respectively, formed in the panel recessed edges and are bonded in place with a thermoset adhesive. The bushings are located to align with respective bushings in overlapping adjacent panels. Bushings 16 are of the same thickness as top joint edges 12 and 13. The upper portion of holes 18 is enlarged or counter bored at 20, as shown in FIGS. 5*a* and 5*b*, to allow flange 21 on bushings 16 to be recessed with the upper surface of the bushing flush with the top surface of the panel joint. Flange 22 on threaded bushings 17 bear against the bottom of edges 14 and 15, as shown. The upper bushing 16 is preferably machined from stressproof steel. The bushing is bored, for example, to a diameter of ⅞ inch to accept a ¾-inch-diam bolt 23 with ⅛-inch alignment tolerance. Bushing 16 is counter bored to a depth of 0.20 inch to recess the head of hex-head bolt 23. The lower bushing 17 also is machined from stressproof steel and is tapped to thread specifications. Bushing 17 is adhesively fastened to the bottom surface of a panel edge with a thermoset epoxy adhesive capable of providing an FRP to-steel lap tensile shear strength of minimum 3,000 psi. Load tests in single shear have demonstrated that a single bolt/bushing combination used for joining typical ½-inch-thick panels (0.375-inch-thick upper edge and 0.25-inch-thick lower edge) has an ultimate load capacity of 9,300 pounds. Bushings are located along panel edges, as shown in FIG. 1, and are spaced apart from 8 to 24 inches, for example. The outer edges of an assembled landing mat are anchored using bushings and anchor bolts to prevent uplift.

As shown in the typical joint connection of FIGS. 5*a* and 5*b*, the lip recessed from the bottom edge 12 overlaps the lip recessed from the top edge 14 of an adjacent panel. The edge surface 27 of lip 12 (FIGS. 2 and 5*a*) may abut with the step surface 28 of lip 14 (FIGS. 3 and 5a) of adjacent panels, as shown at 29 (FIG. 5a) or be slightly spaced apart as shown at 30; the spacing allowing for adjustment in aligning upper bushing 16 with lower bushing 17. The joint is completed by passing bolts 23 through each of upper bushings 16 of the one panel and threading the bolts into the lower bushings 17 of the adjacent lower panel.

Panels 10 are slightly thicker along the top of edges 12 and 13 for stiffening the thin panel edges to prevent excessive deflection at joints from rolling aircraft wheel loads. Increasing the thickness is the most cost-effective way to obtain higher load capacity. Load capacity increases in proportion to the square of the thickness whereas cost increases linearly with the number of plies. Appreciable increase in edge thickness is avoided to prevent exposing panel edges to damage from aircraft tailhooks and the like.

Panels 10 are fabricated of fiberglass-reinforced polyester (FRP) using a wet-layup technique. The basic panel is constructed of 4 plies 24 of 4020 style fiberglass mat. Each ply of 4020 style fiberglass is composed of 40-ounces per square yard of woven roving 25 and 2-ounces per square foot of chopped strand 26, as shown in FIGS. 2 and 3.

The fiberglass mats are impregnated and saturated with a polyester resin, thermosetting, low-pressure, wet-layup type. The cured resin in conjunction with 4020 style fiberglass at a 60:40 resin:glass ratio produces a laminate having the following minimum mechanical properties:

Flexural Strength (ASTM D790-66): 28,800 psi
Tensile Strength (ASTM D638-68): 17,000 psi
Elastic Modulus, Tension (ASTM D638-68): $1.5\times10^6$ psi
Barcol Hardness, #934: 55

A suitable polyester is, for example, PPG Industries resin designated RS50338 which contains approximately 40 percent styrene monomer. This PPG polester resin is activated by the following catalyst system:

Catalyst: Cumeme Hydroperoxide
Promoter: 1:1 by volume N,N-Dimethyl-p-Toluidine and Vanadium Trineodecanoate Promoter and Catalyst concentrations can be varied between 1.2 to 0.31 (catalyst) and 0.3 to 0.08 (promoter) parts per hundred resin depending upon ambient temperature.

To reduce panel weight, cut cost, and improve thermal stability, the polyester resin can be filled with up to 8 percent by weight of resin with hollow inorganic silica microspheres. Philadelphia Quartz Company, for example, produces Q-Cel grade 300 microspheres which are suitable filler. The microsphere filler reduces panel cost by 11 percent and reduces panel weight by 16 percent while simultaneously improving thermal stability.

High-modulus fibers can be used to increase beam flexural strength while maintaining nearly constant thickness. Beam load capacity is maximized by placing these fibers at the greatest distance from the neutral axis. A high-modulus, high-strength fiber—aramid—is used as edge reinforcement. The aramid fibers are considerably stiffer and stronger in tension than "E" glass fibers of the 4020-style fiberglass used as reinforcement of the basic panel. Fabric woven of aramid fibers is an attractive reinforcement because of availability, moderate cost and relative ease of processing. Aramid fabric (e.g., 13.5 oz/ft$^2$, 26×22 count, basket weave, 0.0235-inch thickness) is primarily used as reinforcement along the panel perimeter in areas subject to tension to utilize the material's high tensile strength and modulus for increasing joint flexural strength and stiffness.

Panel joint areas, as shown in FIGS. 2 and 3, are reinforced with two plies of 1350 style fabric of basket woven aramid fiber (e.g., Kelvar-49®). Plies 31 and 32 are added to the bottom recessed edge, and plies 33 and 34 are added to the top recessed edge. The two plies of aramid fabric on each panel edge run the length of all panel edges overlapping at corners. The aramid fabric plies 31, 32, 33 and 34 are positioned, as shown in FIGS. 2 and 3, with plies 32 and 33, respectively, being partly sandwiched at mid panel depth between fiberglass mat plies 24.

The bottom recessed panel edge 12 is reinforced by the addition of one extra ply 37 of 4020-style fiberglass to the top surface, as shown in FIG. 2. This extra fiberglass ply adds thickness to facilitate flush mounting of the upper bushing and is a cost-effective means of increasing flexural strength. The inward edge of the ply is feathered into the panel at 38 during lamination and provides a ramp effect, which transition sliding aircraft tailhooks over the joining bushings/bolts. Feathering as at 38 may be applied at 29 (FIG. 5a) for the same purpose, if desired, following joining of two or more panels 10 into a larger configuration.

After layup and resin curing, panel edges are trimmed to the final panel dimensions. Holes 18 and 19 (e.g., 2.5-inch diameter) are preferably sawed through the panel edges at specified locations (FIG. 1) to accomodate the upper and lower bushings 16 and 17. If desired, holes 18 and 19 can be molded in the panels during layup. The bushings are then adhesively fastened into the holes along the panel edges using a thermoset adhesive. Panel manufacture is completed by coating the top surface (excluding the lower joint area) with a suitable 21 to 24 wet mil thick coating of antiskid compound.

The top surfaces of panels 10 can also be coated with an ablative material which make the panels feasible for construction of a forward pad for operation of VTOL aircraft similar to the Harrier AV8-B. A representative ablative coating is a rubber-modified fiber filled, thermosetting epoxy (e.g., Flexfram-605® manufactured by Fiber Materials, Inc.) which is preferably applied to a thickness of from 20 to 30 mils.

The panels 10 can be assembled into any size configuration of airfield runway, landing pad or apron, such as shown in FIG. 4. The panels can be joined in a brick fashion, as shown at 41, or in a grid fashion as shown at 42.

Each of the panels 10 is notched at diagonally opposite corners 39 and 40, as shown in FIG. 1, to allow for overlapping and joining the edges of any adjacent panels into any desired configuration of landing mat, etc. The depths of the recesses either from the bottom or from the top along respective edges 12, 13, 14 and 15 are the same and substantially equal to the thickness of two of the four impregnated plies 24 shown in FIGS. 2 and 3, or approximately one-half the thickness of the panel excluding the area about the perimeter where there is an extra ply 37 and woven aramid 32 and 34, as shown in FIGS. 2, 3, 5a and 5b; thus, upper lip portions 12 or 13 of an individual panel will not overlap any lower lip portions 14 or 15 of the same panel at diagonally opposite corners 39 and 40.

The portable panels of this invention offer lower weight and cube than prior type matting, thereby improving mobility. Panels are reusable at one-half the cost of currently available matting, and can be linked together to form a large mat for runway bomb crater repair.

When used to form a trafficable cover over backfilled bomb craters in airfield runways, the assembled panels strengthen the crater repair by the distribution of heavy aircraft wheel loads and prevent foreign object damage to aircraft which could otherwise occur from loose backfill materials. The panels are advantageous for use in restoration of damaged airfields and construction of expedient airfields, and can be ideally sized for efficient shipping via ISO standard 8×8×20-foot shipping containers. This type of joined panels represents an advance in the art of expedient airfield surfacing; they are the first traffic proven plastic composite panels which can be field assembled.

Obviously many modifications and variation of the present invention are possible in light of the above teachings. It is therefore to be understood that within the scope of the appended claims the invention may be practiced otherwise than as specifically described.

What is claimed is:

1. Prefabricated plastic-composite portable panels, a plurality of which are jointed together to form expedient airfield surfacing and rapid runway repair, each panel comprising:

a. a plurality of substantially rectangular fiberglass plies impregnated, saturated and bonded together with a thermosetting polyester resin to form a substantially thin, flat, non-porous, laminar structure having low weight and shipping cube;

b. two adjoining edges about the perimeter of said laminar structure being recessed from the bottom to form adjoining upper lips along one side and one end thereof;

c. the remaining two adjoining edges about the perimeter of said laminar structure being recessed from the top to form adjoining lower lips along the opposite side and opposite end thereof;

d. the depth to which said laminar structure edges are recessed to form lips about the entire perimeter thereof being substantially the same such that two diagonally opposite corners of said laminer structure are removed in the areas where said upper lips would otherwise intersect with said lower lips, thus allowing for the overlapping of said upper and lower lips about the edges of said laminar structure with respective lower and upper lips of other like laminer structures when placed adjacent thereto for joining therewith;

e. the perimeter areas of said laminar structure being reinforced with high-modulus, high-tensile-strength fiber material such that both the upper and lower surfaces of said lips about the entire perimeter of said panels are reinforced for maximizing the load capacity of the laminar structure and increasing panel joint flexural strength and stiffness; a portion of said high-modulus, high-tensile-strength fiber material reinforcing the lower side of said upper lip and a portion of said high-modulus, high-tensile-strength fiber material reinforcing the upper side of said lower lip extending into and being sandwiched between two of said plurality of fiberglass plies which form said laminar structure; said laminar structure being constructed slightly thicker about the top edges by the addition of fiberglass plies along the perimeter thereof in the areas where the laminar structure is reinforced with high-modulus, high-tensile-strength fiber material for stiffening the panel edges to obtain higher load capacity and to prevent excessive deflection at joints between joined like adjacent laminar structres due to rolling aircraft wheel type loads;

f. fastening means being provided at spaced intervals along the upper and lower lips of said laminar panel, said fastening means being operable for securely joining said laminar panel with like panels when positioned adjacent thereto; said fastening means comprising flush-mounted upper bushings secured along said upper lip, and lower bushings which are flush-mounted with and secured along said lower lip; said upper and lower bushings being positioned to align with and be bolted together with respective lower and upper bushings in adjacently placed like laminar structures; said upper and lower bushings being adhesively bonded in place;

wherein a plurality of said prefabricated panels when jointed together form lightweight airfield surfacing of high flexural strength and high structural capacity.

2. Prefabricated panels as in claim 1, wherein said fiberglass plies are constructed of 4020 style fiberglass matting composed of woven roving and chopped strand.

3. Prefabricated panels as in claim 1, wherein said polyester resin contains approximately 40 percent styrene monomer.

4. Prefabricated panels as in claim 1, wherein said fiberglass plies are impregnated with said polyester resin at a 60:40 resin:glass ratio to produce said laminar structure.

5. Prefabricated panels as in claim 1, wherein said laminar structure has the following minimum mechanical properties:

Flexural Strength (ASTM D790-66): 29,800 psi
Tensile Strength (ASTM D638-68): 17,000 psi
Elastic Modulus, Tension (ASTM D638-68): $1.5\times10^6$ psi
Barcol Hardness, #934: 55.

6. Prefabricated panels as in claim 1, wherein said polyester resin is filled with up to 8 percent by weight of the resin with hollow inorganic silica microspheres providing improved thermal stability of the panels, and reducing the weight and cost thereof.

7. Prefabricated panels as in claim 1, wherein the recesses forming said upper and lower lips extend inwardly equidistantly from the outer edges of said laminar structure.

8. Prefabricated panels as in claim 1, wherein the edges and lips of said prefabricated panels accomodate with matching edges and lips of like said panels when placed adjacent thereto, such that a plurality of said panels are readily joined together to form an airfield landing mat.

9. Prefabricated panels, a plurality of which are joined together to form expedient airfield surfacing and rapid runway repair, each panel comprising:

a. a plurality of substantially rectangular fiberglass plies impregnated, saturated and bonded together with a thermosetting polyester resin to form a substantially flat laminar structure;

b. two adjoining edges about the perimeter of said laminar structure being recessed from the bottom to form adjoining upper lips along one side and one end thereof;

c. the remaining two adjoining edges about the perimeter of said laminar structure being recessed from the top to form adjoining lower lips along the opposite side and opposite end thereof;

d. the depth to which said laminar structure edges are recessed to form lips about the entire perimeter thereof being substantially the same such that two diagonally opposite corners of said laminer structure are removed in the areas where said upper lips would otherwise intersect with said lower lips, thus allowing for the overlapping of said upper and lower lips about the edges of said laminar structure with respective lower and upper lips of other like laminer structures when placed adjacent thereto for joining therewith;

e. the perimeter areas of said laminar structure being reinforced with high-modulus, high-tensile-strength fiber material for maximizing the load capacity of the laminar structure and increasing panel joint flexural strength and stiffness; a portion of said high-modulus, high-tensile-strength fiber material being on one side of said upper and lower lips and extending into and being sandwiched between two of said plurality of fiberglass plies which form said laminar structure;

f. fastening means being provided at spaced intervals along the upper and lower lips of said laminar panel, said fastneing means being operable for securely joining said laminar panel with like panels when positioned adjacent thereto; said fastening means comprising broad, flanged flush-mounted upper bushings of the same thickness as and secured along said upper lip, and broad, threaded, flanged lower bushings which are flush-mounted with the upper side of said lower lip and secured along said lower lip; said upper and lower bushings being positioned to align with and be bolted together with respective lower and upper bushings in adjacently placed like laminar structures; said upper and lower bushings being adhesively bonded in place; said lower bushings being adhesively bonded to the bottom surface of said lower lips to provide an FRP to steel lap tensile shear strength of a minimum of 3,000 psi;

wherein a plurality of said prefabricated panels when joined together form lightweight airfield surfacing of high flexural strength and high structural capacity.

10. Prefabricated panels as in claim 9, wherein the top two edges of said laminar structure along which said upper lips are formed are provided with an additional fiberglass ply for stiffening panel edges to prevent excessive deflection at panel joints due to heavy loads.

11. Prefabricated panels as in claim 9, wherein both sides of said upper and lower lips, respectively, are reinforced with a material of high-modulus, high-strength fibers to increase their beam flexural strength while maintaining nearly constant thickness thereof.

12. Prefabricated panels as in claim 11, wherein said high-modulus, high-strength fiber material is of woven aramid fibers.

13. Prefabricated panels as in claim 9, wherein said laminar structure is constructed slightly thicker along the top edges about the perimeter thereof in the area where the laminar structure is reinforced with high-modulus, high-tensile-strength fiber material for stiffening the panel edges to obtain higher load capacity and to prevent excessive deflection at joints between joined adjacent like laminar structures due to rolling aircraft wheel type loads.

* * * * *